US009161625B2

(12) United States Patent
Chen et al.

(10) Patent No.: US 9,161,625 B2
(45) Date of Patent: Oct. 20, 2015

(54) SLIDE RAIL ASSEMBLY

(71) Applicants: KING SLIDE WORKS CO., LTD., Kaohsiung (TW); KING SLIDE TECHNOLOGY CO., LTD., Kaohsiung (TW)

(72) Inventors: Ken-Ching Chen, Kaohsiung (TW); Shun-Ho Yang, Kaohsiung (TW); Chien-Li Huang, Kaohsiung (TW); Chun-Chiang Wang, Kaohsiung (TW)

(73) Assignees: King Slide Works Co., Ltd., Kaohsiung (TW); King Slide Technology Co., Ltd., Kaohsiun (TW)

( * ) Notice: Subject to any disclaimer, the term of this patent is extended or adjusted under 35 U.S.C. 154(b) by 88 days.

(21) Appl. No.: 14/075,054

(22) Filed: Nov. 8, 2013

(65) Prior Publication Data

US 2015/0129526 A1 May 14, 2015

(51) Int. Cl.
*A47B 88/04* (2006.01)

(52) U.S. Cl.
CPC ..... *A47B 88/044* (2013.01)

(58) Field of Classification Search
CPC .... A47B 88/044; A47B 88/08; A47B 88/047; H05K 7/1489; H05K 7/1421; H05K 7/183
USPC ..... 211/26, 190–192, 183, 187, 175; 312/334.5, 334.1, 334.4, 334.7, 265.1, 312/333, 319.1, 265.4, 330.1, 223.1, 223.2; 361/727
See application file for complete search history.

(56) References Cited

U.S. PATENT DOCUMENTS

| | | | | |
|---|---|---|---|---|
| 5,833,337 | A * | 11/1998 | Kofstad | 312/334.5 |
| 6,230,903 | B1 * | 5/2001 | Abbott | 211/26 |
| 6,303,864 | B1 | 10/2001 | Johnson et al. | |
| 6,375,290 | B1 * | 4/2002 | Lin et al. | 312/334.46 |
| 6,412,891 | B1 * | 7/2002 | Liang et al. | 312/334.44 |
| 6,457,790 | B1 * | 10/2002 | Liang et al. | 312/334.46 |
| 6,601,933 | B1 * | 8/2003 | Greenwald | 312/333 |
| 6,681,942 | B2 | 1/2004 | Haney | |
| 6,685,033 | B1 | 2/2004 | Baddour et al. | |
| 6,747,874 | B2 | 6/2004 | McKinnon et al. | |
| 6,840,388 | B2 * | 1/2005 | Mayer | 211/26 |
| 6,945,619 | B1 * | 9/2005 | Chen et al. | 312/334.47 |
| 6,948,691 | B2 * | 9/2005 | Brock et al. | 248/222.13 |
| 7,055,701 | B2 | 6/2006 | Dean et al. | |
| 7,218,526 | B2 | 5/2007 | Mayer | |
| 7,703,734 | B2 * | 4/2010 | Chen et al. | 248/298.1 |
| 7,712,615 | B2 * | 5/2010 | Chen et al. | 211/26 |
| 7,798,582 | B2 * | 9/2010 | Yu et al. | 312/334.4 |
| 7,823,994 | B2 | 11/2010 | Yang et al. | |
| 8,353,489 | B2 | 1/2013 | Phelan et al. | |
| 8,356,718 | B2 | 1/2013 | Yang | |
| 8,456,843 | B2 * | 6/2013 | Wang et al. | 361/724 |

(Continued)

*Primary Examiner* — Joshua Rodden
*Assistant Examiner* — Hiwot Tefera
(74) *Attorney, Agent, or Firm* — Rosenberg, Klein & Lee

(57) ABSTRACT

A slide rail assembly includes a first rail, a second rail, a third rail, a support member and a resilient member. The second rail is slidably connected to the first rail to which the third rail is connected. The support member is movably connected to the third rail and has a side portion and a stop portion. The side portion has at least one first slot, and a first connecting member extends through the at least one first slot and is connected to the third rail. The resilient member generates an elastic force in response to a relative movement between the support member and the third rail. The support member is movable relative to the third rail and contacts against the chassis.

10 Claims, 7 Drawing Sheets

(56) References Cited

U.S. PATENT DOCUMENTS

| | | | | |
|---|---|---|---|---|
| 2001/0040203 | A1* | 11/2001 | Brock et al. | 248/222.11 |
| 2002/0084735 | A1* | 7/2002 | Liang et al. | 312/334.46 |
| 2005/0029913 | A1* | 2/2005 | He | 312/334.44 |
| 2005/0206285 | A1* | 9/2005 | Greenwald et al. | 312/334.5 |
| 2007/0247044 | A1* | 10/2007 | Adams et al. | 312/334.5 |
| 2008/0303390 | A1* | 12/2008 | Hsiung et al. | 312/223.1 |
| 2009/0261699 | A1* | 10/2009 | Yu et al. | 312/334.46 |
| 2011/0053485 | A1* | 3/2011 | Huang et al. | 454/184 |
| 2012/0193489 | A1* | 8/2012 | Yu et al. | 248/201 |

* cited by examiner

SLIDE RAIL ASSEMBLY

BACKGROUND OF THE INVENTION

1. Fields of the invention

The present invention relates to a slide rail assembly, and more particularly, to a slide assembly suitable for installing the chassis of different sizes and providing sufficient support to improve the stability of the chassis installation.

2. Descriptions of Related Art

U.S. Pat. Nos. 8,356,718, 6,681,942 and 7,823,994 discloses the conventional slide rail assemblies utilized in rack systems and are incorporated herein by reference. However, these conventional slide rail assemblies are not adapted to the chassis of different sizes such that those conventional slide rail assemblies cannot provide sufficient support to the longer chassis.

The present invention intends to provide a slide rail assembly that is adapted to the racks of different sizes and the chassis of different sizes as well so as to provide sufficient support for the chassis and improve the stability of the chassis installation.

SUMMARY OF THE INVENTION

The present invention relates to a slide rail assembly. The slide rail assembly comprises a first rail, a second rail slidably connected to the first rail, a third rail connected to the first rail and having a side plate and a support portion, the support portion extending perpendicularly from a bottom of the side plate, a support member movably connected to the third rail and having a side portion and a stop portion, the stop portion perpendicularly connected to the side portion, the side portion having at least one first slot, a first connecting member extending through the at least one first slot and connected to the side plate of the third rail, and a resilient member for generating an elastic force in response to a relative movement between the support member and the third rail.

Preferably, the side portion of the support member has a second slot. A second connecting member extends through the second slot and is connected to the side plate of the third rail.

Preferably, the third rail has a threaded portion located corresponding to the at least one first slot of the support member. A screw member extends through the at least one first slot of the support member and is engaged with the threaded portion.

Preferably, the slide rail assembly further comprises a cable management arm is connected to the support member.

Preferably, the first rail has a first hook portion. The third rail has a window. The support member has a second hook portion extending through the window and located corresponding to the first hook portion. The resilient member is connected between the first and second hook portions.

Preferably, the first rail has a top wall, a bottom wall and a side wall. The side wall is connected between the top and bottom walls. The third rail has a first lateral plate and a second lateral plate. The first lateral plate extends from a top of the side plate of the third rail. The first lateral plate is substantially perpendicular to the side plate. The second lateral plate extends downwardly from the first lateral plate. The second lateral plate is substantially perpendicular to the first lateral plate. The first and second lateral plates form a hook coupled with the top wall of the first rail such that the third rail is hung on the first rail by the hook.

The present invention also provides a slide rail assembly installed to a chassis. The slide rail assembly comprises a first rail, a second rail slidably connected to the first rail, a third rail connected to the first rail and having a support portion, the chassis located on the support portion, a support member movably connected to the third rail and having a stop portion located corresponding to the chassis, and a resilient member for generating an elastic force in response to a relative movement between the support member and the third rail, wherein the stop portion of the support member contacts against the chassis by the elastic force generated by the resilient member.

Preferably, the support member has a first slot and a second slot. A first connecting member and a second connecting member extend through the first slot and the second slot, respectively, and are connected to the third rail.

Preferably, the support member has a first slot, the third rail has a threaded portion located corresponding to the first slot of the support member. A screw member extends through the first slot of the support member and is engaged with the threaded portion.

The present invention yet provides a rack system. The rack system comprises a rack having two first posts and two second posts, a first slide rail assembly connected between a respective one of the two first posts and a respective one of the two second posts, a second slide rail assembly connected between the other one of the two first posts and the other one of the two second posts, and a chassis installed between the first slide rail assembly and the second slide rail assembly. The first slide rail assembly comprises a first rail connected to a first support part, the first support part connected to the respective one of the two first posts, a second rail slidably connected to the first rail and connected to a second support part, the second support part connected to the respective one of the two second posts, a third rail connected to the first rail and having a support portion for supporting the chassis, a support member movably connected to the third rail and having a stop portion, the stop portion located corresponding to the chassis, and a resilient member for generating an elastic force in response to a relative movement between the support member and the third rail, the stop portion of the support member contacting against the chassis by the elastic force generated by the resilient member.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
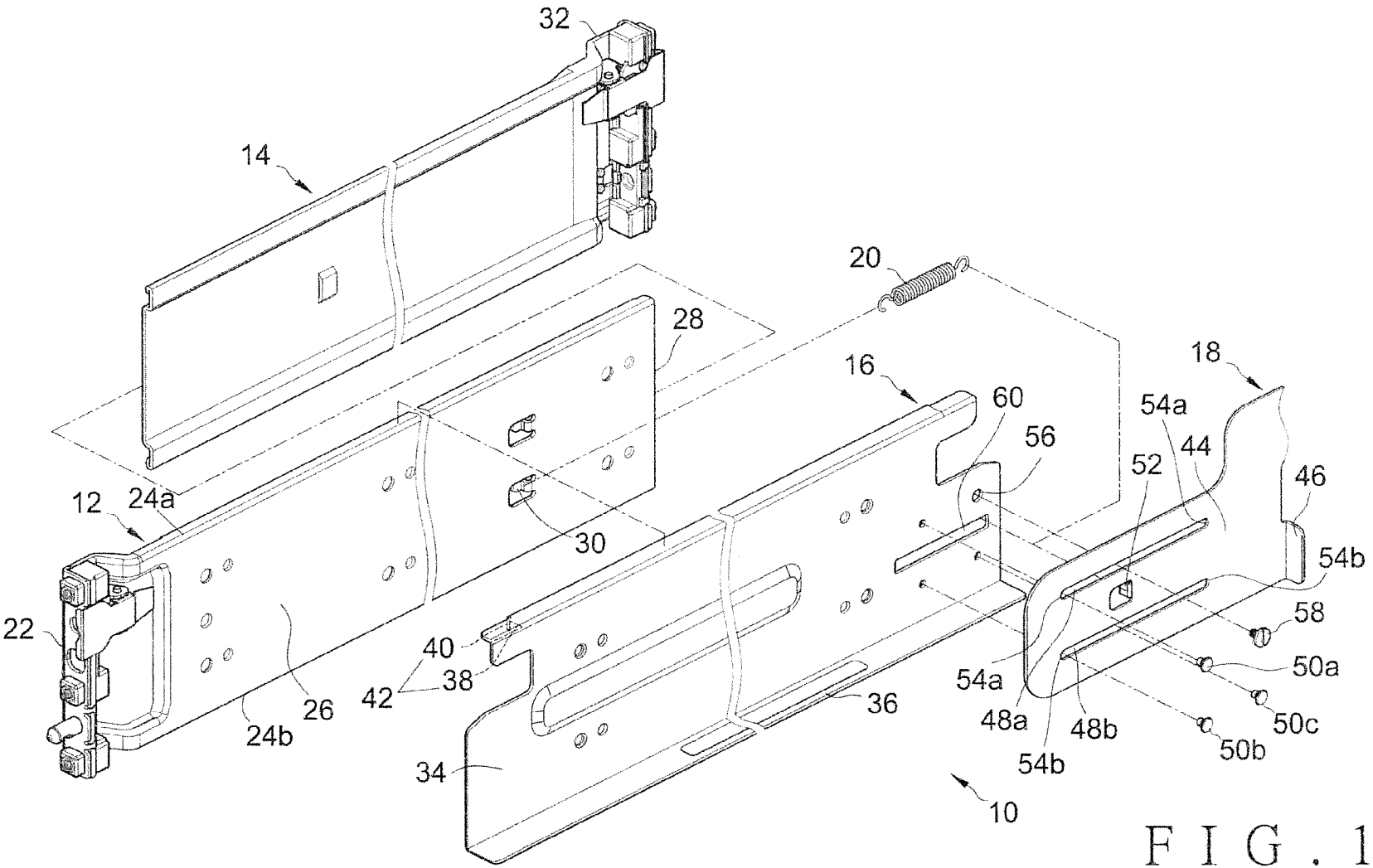
FIG. 1 is an exploded view of a slide rail assembly in accordance with a preferred embodiment of the present invention.
Figure 2:
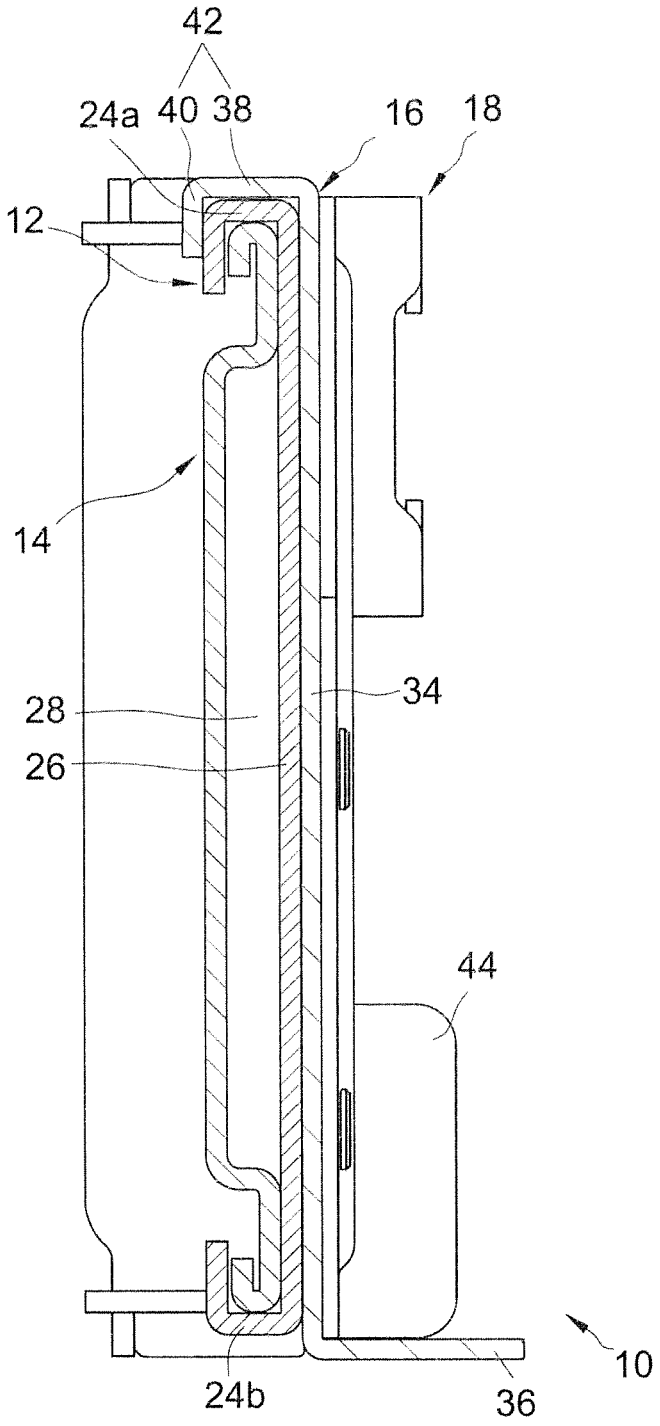
FIG. 2 is a cross sectional view of the slide rail assembly in accordance with the preferred embodiment of the present invention.

FIGS. 1 and 2 show a slide rail assembly 10 in accordance with a preferred embodiment of the present invention. The slide rail assembly 10 comprises a first rail 12, a second rail 14 slidably connected to the first rail 12, a third rail 16 connected to the first rail 12, a support member 18 movably connected to the third rail 16, and a resilient member 20 connected between the support member 18 and the first rail 12. The resilient member 20 generates an elastic force in response to a relative movement between the support member 18 and the third rail 16.

Figure 3A:
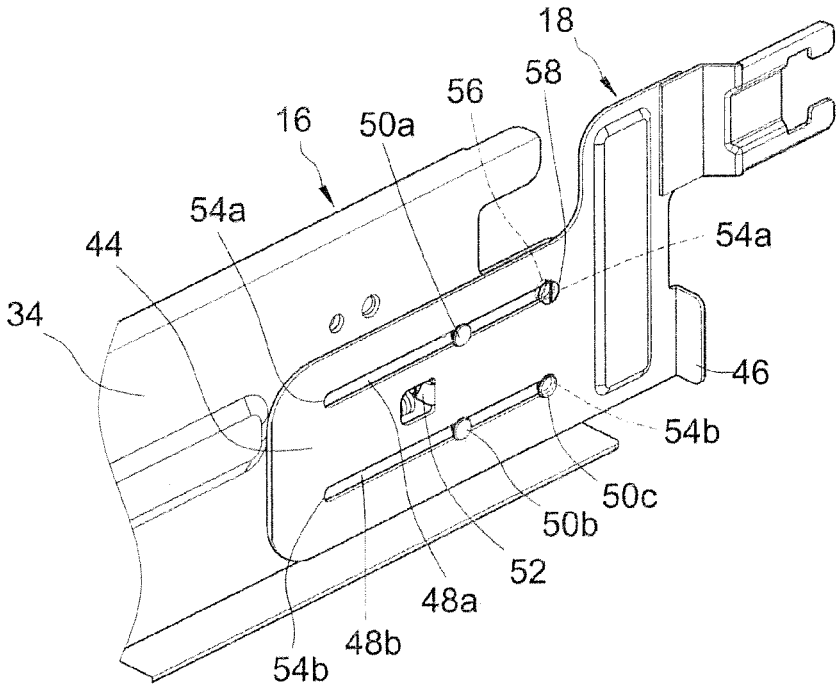
FIG. 3A is an enlarged view of a portion of the slide rail assembly in accordance with the preferred embodiment of the present invention.

The first rail 12 is connected to a first support part 22 used to install the first rail 12 to a position of a rack (not shown in FIGS. 1 and 2). The first rail 12 has a top wall 24*a*, a bottom wall 24*b* and a side wall 26. The side wall 26 is connected between the top and bottom walls 24*a*, 24*b* such that the top wall 24*a*, the bottom wall 24*b* and the side wall 26 define a longitudinal passage 28. Further, a first hook portion 30 is formed on the side wall 26. The second rail 14 is connected to a second support part 32 used to install the second rail 14 to another position of a rack (not shown in FIGS. 1 and 2). The second rail 14 is slidably coupled to the longitudinal passage 28 and allowed to slide along the longitudinal passage 28 relative to the first rail 12 so as to adjust the extended length of the slide rail assembly 10. The third rail 16 is connected to the first rail 12 and has a side plate 34 and a support portion 36. The support portion 36 extends perpendicularly from a bottom of the side plate 34. Preferably, the third rail 16 has a first lateral plate 38 and a second lateral plate 40. The first lateral plate 38 extends from a top of the side plate 34 and is substantially perpendicular to the side plate 34. The second lateral plate 40 extends downwardly from an edge of the first lateral plate 38 and is substantially perpendicular to the first lateral plate 38. The first and second lateral plates 38, 40 form a hook 42 that is coupled with the top wall 24*a* of the first rail 12 such that the third rail 16 is hung on the first rail 12 by the hook 42. FIG. 3A shows that the support member 18 is movably connected to the third rail 16. The support member 18 has a side portion 44 and a stop portion 46 connected and substantially perpendicular to the side portion 44. The side portion 44 has a first slot 48*a* and a second slot 48*b*. A first connecting member 50*a* and a second connecting member 50*b* extend through the first slot 48*a* and the second slot 48*b*, respectively, and are connected to the side plate 34 of the third rail 16 such that the support member 18 is connected to the third rail 16. The support member 18 is guided by the first and second connecting members 50*a*, 50*b* to move relative to the third rail 16 in longitudinal direction. Preferably, a third connecting member 50*c* extends through the second slot 48*b* and is connected to the side plate 34 of the third rail 16. Further, the side portion 44 has a second hook portion 52.

The first, second and third connecting members 50*a*, 50*b*, 50*c* may be three individual members which are secured to the side plate 34 of the third rail 16 by rivets or other connection means. Alternatively, the first, second and third connecting members 50*a*, 50*b*, 50*c* may be integrally formed with the third rail 16 and be deemed as a portion of the third rail 16. The side portions 44 has an end face 54*a* located adjacent to the two ends of the first slot 48*a* and another end face 54*b* located adjacent to the two ends of the second slot 48*b*. The end faces 54*a*, 54*b* define the boundaries of the first and second slots 48*a*, 48*b*, respectively, to prevent the support member 18 from being disconnected from the third rail 16 when the support member 18 moves relative to the third rail 16.

Preferably, the third rail 16 has a threaded portion 56 located corresponding to the first slot 48*a* of the support member 18 such that a screw member 58 is allowed to extend through the first slot 48*a* of the support member 18 to engage with the threaded portion 56. Specifically, the threaded portion 56 is a threaded hole or the like; thereby, after the support member 18 is moved relative to the third rail 16 and located at an appropriate position, the screw member 58 is firmly engaged with the threaded portion 56 to secure the support member 18 to the third rail 16.

Figure 3B:
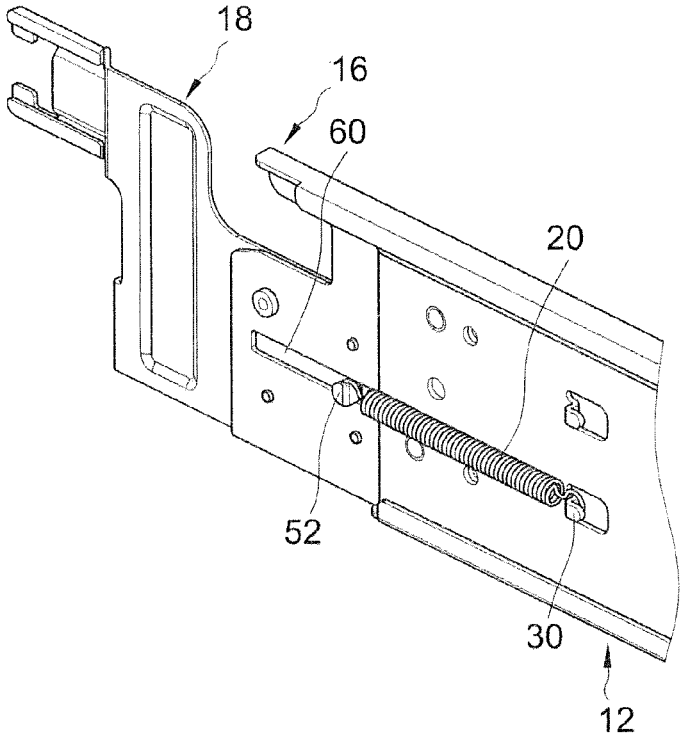
FIG. 3B is another angle view of the portion shown in FIG. 3A.

FIG. 3B shows that the resilient member 20 are connected between the first hook portion 30 of the first rail 12 and the second hook portion 52 of the support member 18. Specifically, the third rail 16 has a window 60, and the second hook portion 52 extends through the window 60 and is located corresponding to the first hook portion 30. Therefore, the resilient member 20 generates the elastic force in response to the relative movement between the support member 18 and the third rail 16.

Figure 4:
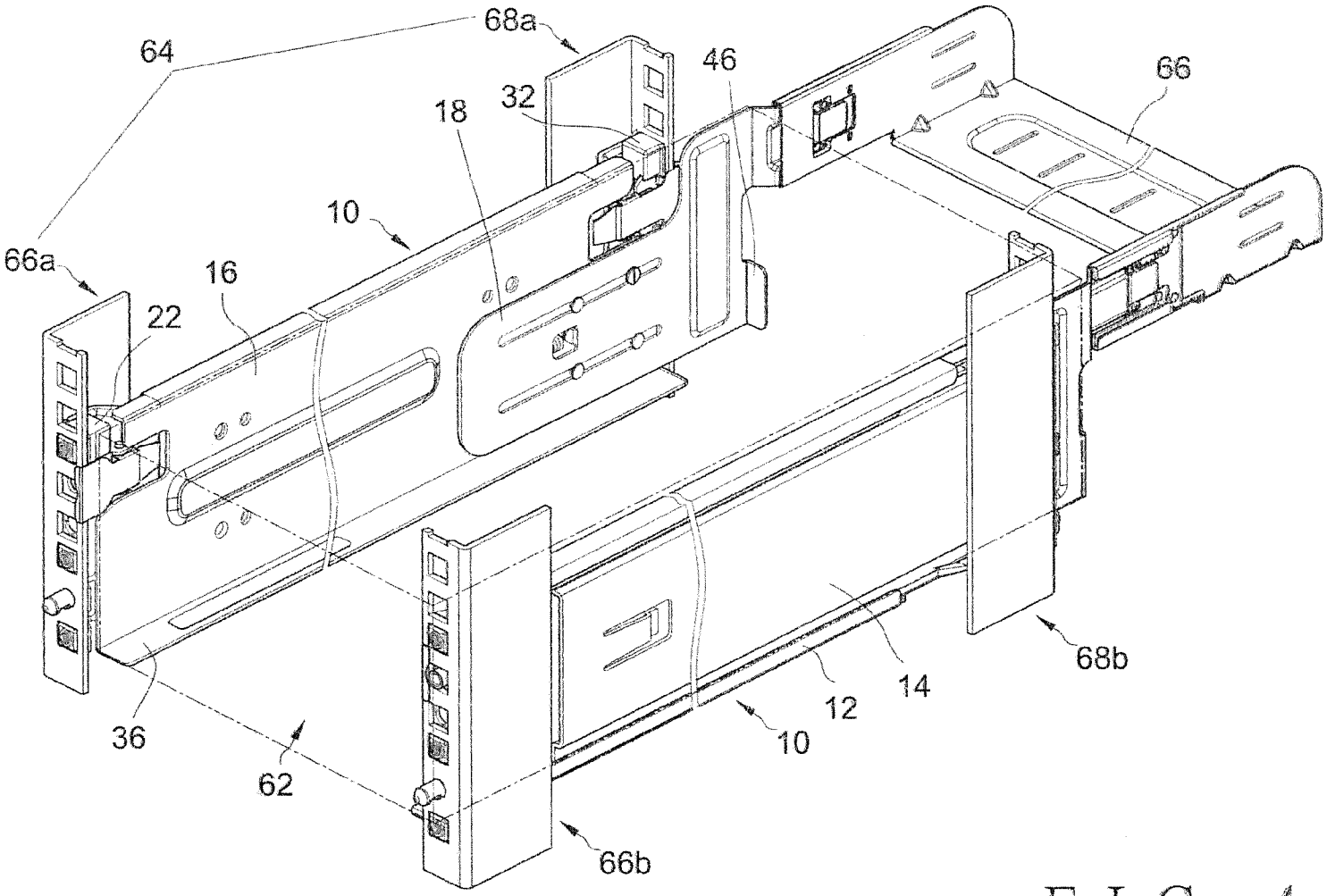
FIG. 4 is a schematic view that illustrates a chassis being installed to a rack by the slide rail assembly in accordance with the preferred embodiment of the present invention.

FIG. 4 shows a rack system in accordance with a preferred embodiment of the present invention. In this embodiment, the rack system comprises two identical slide rail assemblies 10 that are symmetrically located and used to install a chassis 62 to a rack 64. The extended length of each of the two slide rail assemblies 10 can be adjusted to reach a desired length, that corresponds to the longitudinal depth of the rack 64 by moving the second rail 14 relative to the first rail 12 such that the two slide rail assemblies 10 are adapted to racks 64 of different sizes. Specifically, the rack 64 comprises two first posts 66*a*, 66*b* and two second posts 68*a*, 68*b*.

The first rail 12 of each of the two slide rail assemblies 10 is respectively connected to one of the two first posts 66*a*, 66*b* by the first support part 22, and the second rail 14 of each of the two slide rail assemblies 10 is respectively connected to one of the two second posts 68*a*, 68*b* by the second support part 32. Thereby, the chassis 62 is allowed to be positioned on the two slide rail assemblies 10 with the bottom of the chassis 62 supported by the support portions 36 of the third rails 16 of the two slide rail assemblies 10. Furthermore, the support member 18 of each of the two slide rail assemblies 10 is able to be moved according to the length of the chassis 62 and permits the stop portion 46 thereof to contact against the chassis 62. Preferably, a cable management arm 66 is connected to the support members 18 of the two slide rail assemblies 10 to manage the cables (not shown) of the chassis 62.

It should be noted that the embodiment of which comprises two slide rail assemblies 10 as described above is used to exemplify the installation of the chassis 62 rather than limit the number of the slide rail assembly 10.

Figure 5:
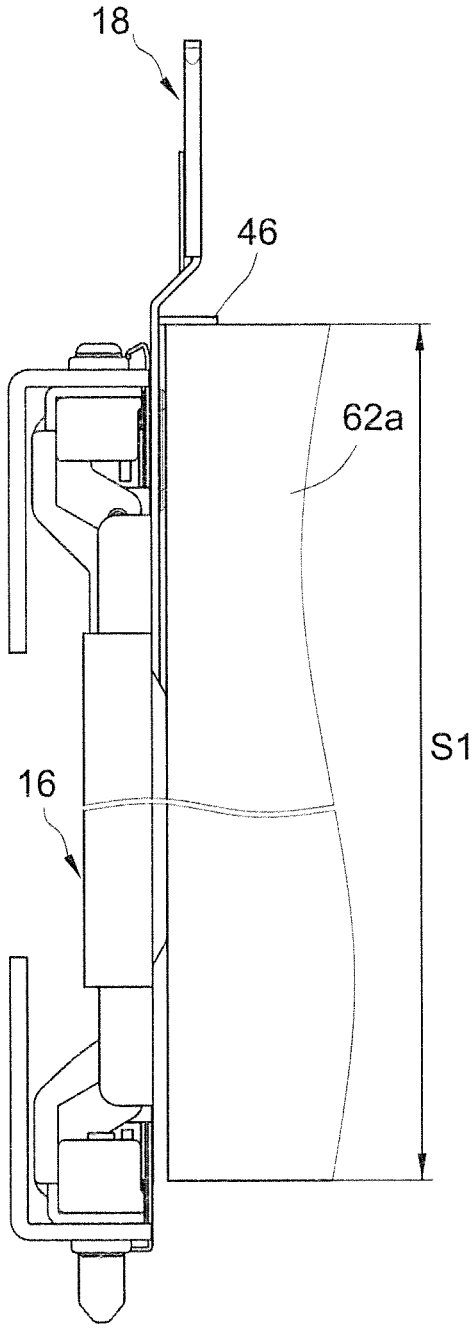
FIG. 5 is a side view that illustrates the installation of a chassis having a first length.
Figure 6:
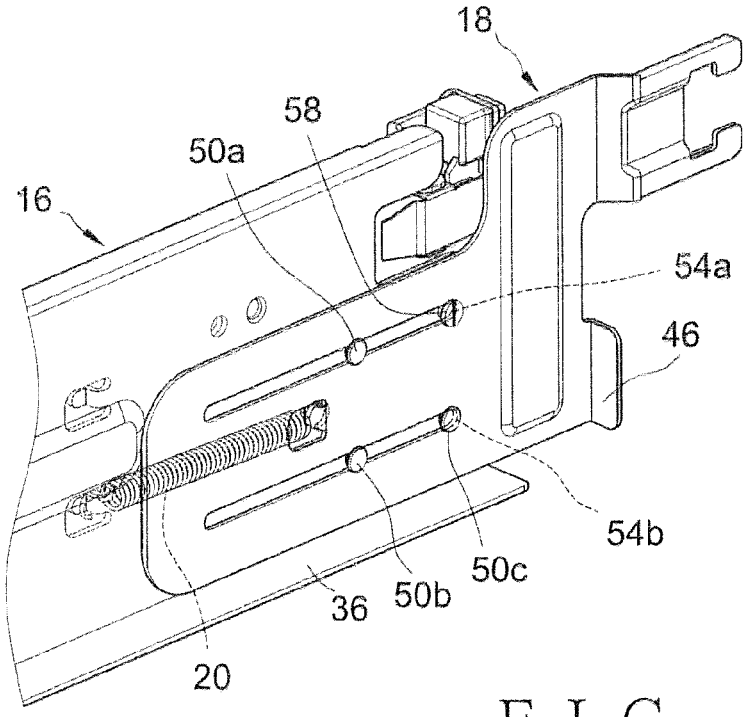
FIG. 6 is a schematic view of a support member of the slide rail assembly in accordance with the preferred embodiment of the present invention, in which the support member is not yet pulled.

FIG. 5 shows a chassis 62*a* having a first length S1 , in which the support member 18 is retracted to a minimum extended position (as shown in FIG. 6) by the resilient member 20, and the stop portion 46 of the support member 18 contacts against the chassis 62*a* and provides a lateral support for the chassis 62*a*. Therefore, the chassis 62*a* is well supported and positioned by the support portion 36 of the third rail 16 and the stop portion 46 of the support member 18.

Figure 7:
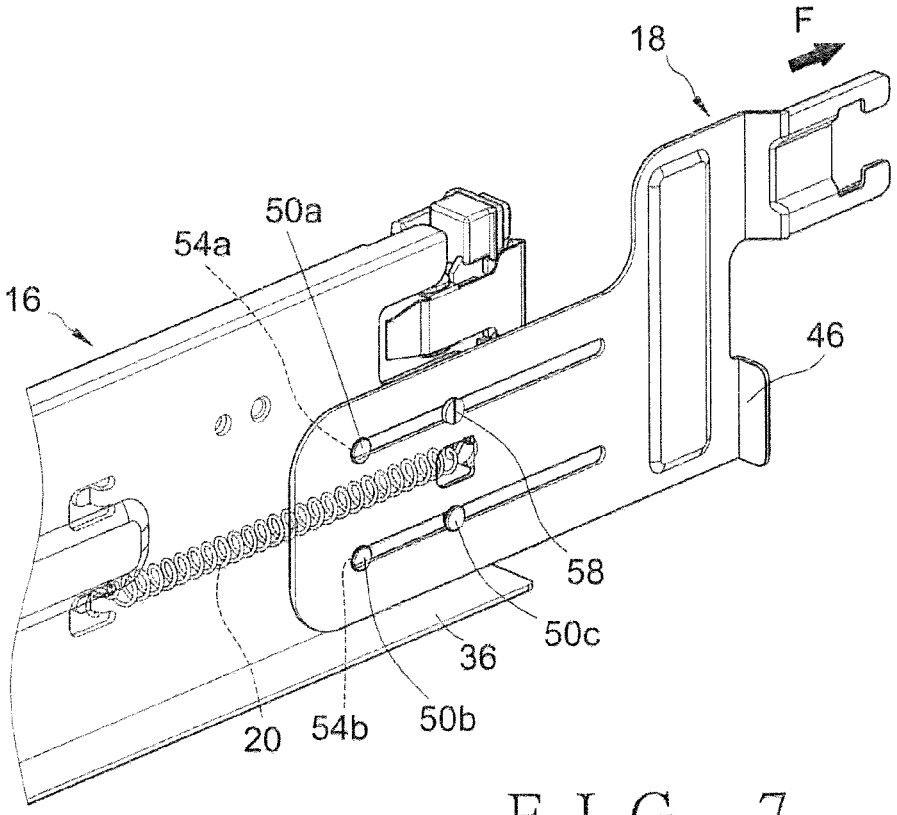
FIG. 7 is a schematic view of the support member shown in FIG. 6, in which the support member is pulled.
Figure 8:
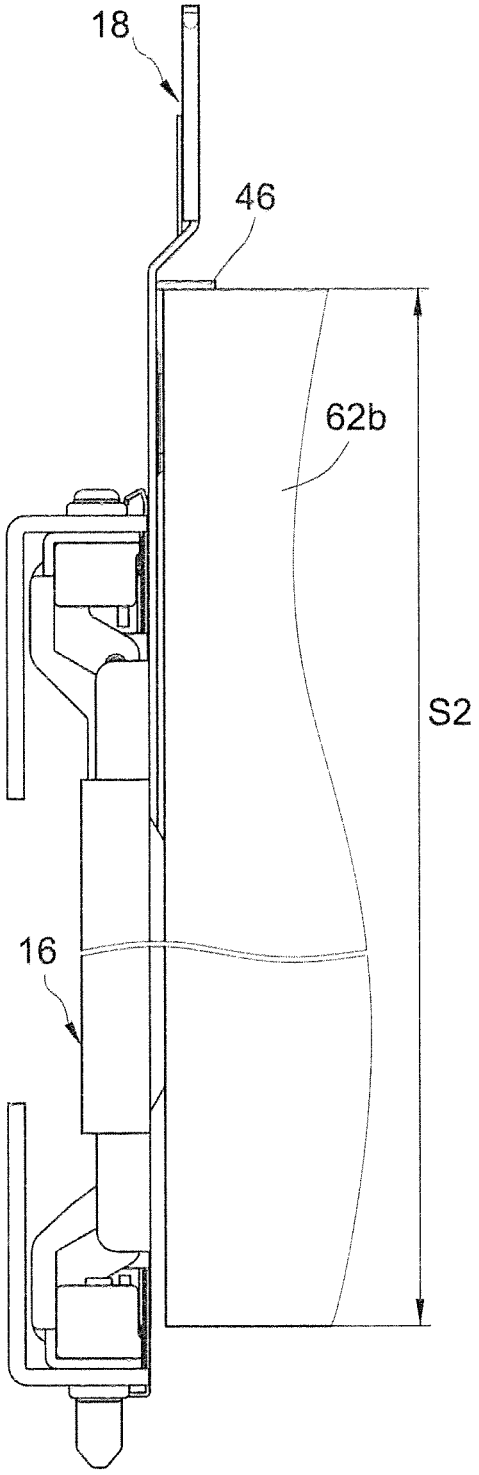
FIG. 8 is a side view that illustrates the installation of a chassis having a second length.

FIG. 8 shows a chassis 62*b* having a second length S2 longer than the first length S1. To accommodate the chassis 62*b*, a force F of a first direction (as shown in FIG. 7) is applied to the support member 18 to pull the support member 18 to move relative to the third rail 16, such that the resilient member 20 is extended and simultaneously generates a continuous elastic force of a second direction, opposite to the first direction, in response to the relative movement between the support member 18 and the third rail 16. The continuous elastic force of the second direction keeps the stop portion 46 of the support member 18 contacting against the chassis 62*b*. In addition, the connection between the support member 18 and the third rail 16 can be improved by firmly engaging the screw member 58 with the threaded portion 56 after the stop portion 46 of the support member 18 contacts against the chassis 62*b*. Therefore, the chassis 62*b* also can be well supported and positioned by the support portion 36 of the third rail 16 and the stop portion 46 of the support member 18.

Furthermore, it is noted that the support member 18 is guided by the first, second and third connecting members 50*a*, 50*b*, 50*c* to move relative to the third rail 16 in longitudinal direction. Preferably, the end faces 54*a*, 54*b* of the support member 18 contact the first and second connecting members 50*a*, 50*b* to stop the support member 18 when the support member 18 moves to a maximum extended position (as shown in FIG. 7). Similarly, the end face 54*b* of the support member 18 contacts the third connecting member 50*c* to stop the support member 18 when the support member 18 moves to the minimum extended position (as shown in FIG. 6). Therefore, the end faces 54*a*, 54*b* prevent the support member 18 from being disconnected from the third rail 16.

In conclusion, the support portion 36 of the third rail 16 and the stop portion 46 of the support member 18 can provide a sufficient support to the chassis 62*a* and the chassis 62*b* individually. In other words, the present invention is adapted to chassis 62 of different sizes.

While we have shown and described the embodiment in accordance with the present invention, it should be clear to those skilled in the art that further embodiments may be made without departing from the scope of the present invention.

What is claimed is:

1. A pair of slide rail assemblies for accommodating a chassis therebetween, the pair comprising:

a first slide rail assembly;

a second slide rail assembly; and a chassis receiving space defined between the first slide rail assembly and the second slide rail assembly;

wherein the first slide rail assembly and the second slide rail assembly are each mounted to a pair of mounting posts, each slide rail assembly including:

a first rail extending in a longitudinal direction;

a second rail extending in the longitudinal direction and slidably connected to the first rail, wherein the first rail is mounted to a corresponding mounting post and the second rail is mounted to a corresponding another of the pair of mounting posts;

a third rail extending in the longitudinal direction and connected to the first rail, the third rail having a side plate extending in the longitudinal direction and a support portion extending transversely from a bottom portion of the side plate into the chassis receiving space to receive the chassis thereon;

a support member movably connected to the third rail and having a side portion extending in the longitudinal direction and a stop portion extending transversely from a rear end of the side portion into the chassis receiving space to contact an end of the chassis, the side portion having at least one first slot, a first connecting member extending through the at least one first slot and connected to the side plate of the third rail to movably connect the support member to the third rail; and a resilient member having a first end connected to the first rail and a second end connected to the support member for generating an elastic force in response to a relative movement between the support member and the third rail;

wherein the stop portions of the first and second slide rail assemblies adjustably position the chassis responsive to a length of the chassis.

2. The slide rail assembly as claimed in claim 1, wherein the side portion of the support member has a second slot, and a second connecting member extends through the second slot and is connected to the side plate of the third rail.

3. The slide rail assembly as claimed in claim 1, wherein the third rail has a threaded portion located corresponding to the at least one first slot of the support member, and a screw member extends through the at least one first slot of the support member and is engaged with the threaded portion.

4. The slide rail assembly as claimed in claim 1, further comprising a cable management arm connected to the support member.

5. The slide rail assembly as claimed in claim 1, wherein the first rail has a first hook portion, the third rail has a window, the support member has second hook portion extending through the window and located corresponding to the first hook portion, and the resilient member is connected between the first and second hook portions.

6. The slide rail assembly as claimed in claim 1, wherein the first rail has a top wall, a bottom wall and a side wall, the side wall is connected between the top and bottom walls, the third rail has a first lateral plate and a second lateral plate, the first lateral plate extends from a top of the side plate of the third rail, the first lateral plate is substantially perpendicular to the side plate, the second lateral plate extends downwardly from the first lateral plate, the second lateral plate is substantially perpendicular to the first lateral plate, and the first and second lateral plates form a hook coupled with the top wall of the first rail such that the third rail is hung on the first rail by the hook.

7. A pair of slide rail assemblies for accommodating a chassis therebetween, the pair comprising:

a first slide rail assembly;

a second slide rail assembly; and a chassis receiving space defined between the first slide rail assembly and the second slide rail assembly;

wherein the first slide rail assembly and the second slide rail assembly are each mounted to a pair of mounting posts, each slide rail assembly including:

a first rail extending in a longitudinal direction;

a second rail extending in the longitudinal direction and slidably connected to the first rail, wherein the first rail is mounted to a corresponding mounting post and the second rail is mounted to a corresponding another of the pair of mounting posts;

a third rail extending in the longitudinal direction and connected to the first rail, the third rail having a support portion extending transversely from a bottom portion of the third rail into the chassis receiving space to receive the chassis thereon;

a support member movably connected to the third rail and having a stop portion extending transversely from a rear end of the support member into the chassis receiving space to contact an end of the chassis; and a resilient member having a first end connected to the first rail and a second end connected to the support member for generating an elastic force in response to a relative movement between the support member and the third rail, the stop portion of the support member pressing against the chassis by responsive to the elastic force generated by the resilient member, wherein the stop portions of the first and second slide rail assemblies adjustably position the chassis responsive to a length of the chassis.

8. The slide rail assembly as claimed in claim 7, wherein the support member has a first slot and a second slot, and a first connecting member and a second connecting member extend through the first slot and the second slot, respectively, and are connected to the third rail.

9. The slide rail assembly as claimed in claim 7, wherein the support member has a first slot, the third rail has a threaded portion located corresponding to the first slot of the support member, and a screw member extends through the first slot of the support member and is engaged with the threaded portion.

10. A rack system comprising:

a rack having two first posts and two second posts;

a first slide rail assembly connected between a respective one of the two first posts and a respective one of the two second posts;

a second slide rail assembly connected between the other one of the two first posts and the other one of the two second posts; and a chassis receiving space defined between the first slide rail assembly and the second slide rail assembly, wherein the first slide rail assembly includes:

a first rail having a first support part connected to the respective one of the two first posts and extending in a longitudinal direction;

a second rail extending in the longitudinal direction and slidably connected to the first rail and having a second support part connected to the respective one of the two second posts;

a third rail extending in the longitudinal direction and connected to the first rail, the third rail having a support portion extending transversely from a bottom portion of the third rail into the chassis receiving space to receive the chassis thereon;

a support member movably connected to the third rail and having a stop portion extending transversely from a rear end of the support member into the chassis receiving space to contact an end of the chassis; and a resilient member having a first end connected to the first rail and a second end connected to the support member for generating an elastic force in response to a relative movement between the support member and the third rail, the stop portion of the support member pressing against the chassis by responsive to the elastic force generated by the resilient member wherein the stop portion of the first slide rail assembly adjustably positions the chassis responsive to a length of the chassis.

* * * * *